US011001787B2

(12) United States Patent
Pont et al.

(10) Patent No.: US 11,001,787 B2
(45) Date of Patent: May 11, 2021

(54) USE OF ENZYMES, COMPOSITION AND METHOD FOR REMOVING SOIL

(71) Applicant: NOVOZYMES A/S, Bagsvaerd (DK)

(72) Inventors: Elena Genesca Pont, København S (DK); Sofia Arnehed, Tygelsjö (SE); Maria Norman Hockauf, Stenloese (DK); Ana Maria Pardos Blasco, Copenhagen S (DK); Bitten Plesner, Copenhagen NV (DK)

(73) Assignee: NOVOZYMES A/S, Bagsvaerd (DK)

( * ) Notice: Subject to any disclaimer, the term of this patent is extended or adjusted under 35 U.S.C. 154(b) by 0 days.

(21) Appl. No.: 16/312,339

(22) PCT Filed: Jun. 15, 2017

(86) PCT No.: PCT/EP2017/064673

§ 371 (c)(1),
(2) Date: Dec. 21, 2018

(87) PCT Pub. No.: WO2017/220422

PCT Pub. Date: Dec. 28, 2017

(65) Prior Publication Data

US 2019/0233766 A1 Aug. 1, 2019

(30) Foreign Application Priority Data

Jun. 23, 2016 (EP) ..... 16175968

(51) Int. Cl.

| | |
|---|---|
| ***C11D 1/00*** | (2006.01) |
| ***C11D 3/386*** | (2006.01) |
| ***B08B 3/04*** | (2006.01) |

(52) U.S. Cl.

CPC ..... *C11D 3/38618* (2013.01); *C11D 3/386* (2013.01); *C11D 3/38627* (2013.01); *C11D 3/38636* (2013.01); *C11D 3/38645* (2013.01); *C11D 3/38654* (2013.01)

(58) Field of Classification Search

CPC ..... C11D 1/00; C11D 3/042; C11D 3/386; B08B 3/04

See application file for complete search history.

(56) References Cited

U.S. PATENT DOCUMENTS

| | | | | |
|---|---|---|---|---|
| 5,551,990 | A | 9/1996 | Van Dijk | |
| 2012/0172280 | A1 | 7/2012 | Knotzel | |
| 2012/0252106 | A1 | 10/2012 | Knotzel | |
| 2014/0251385 | A1* | 9/2014 | Kelly-Murray | A47L 15/0007 134/25.2 |
| 2015/0107629 | A1* | 4/2015 | Stott, II | C11D 3/386 134/25.2 |

(Continued)

FOREIGN PATENT DOCUMENTS

| | | |
|---|---|---|
| EP | 0070587 A1 | 1/1983 |
| EP | 0271155 A2 | 6/1988 |

(Continued)

*Primary Examiner* — Brian P Mruk
(74) *Attorney, Agent, or Firm* — Kelly Reynolds

(57) ABSTRACT

The present invention concerns the use of enzymes for removing soil from a surface during the rising of the surface, wherein the rinsing is following a washing cycle. The invention further concerns a rinse aid composition for rinsing the surface and a method for removing soil from the surface during a rinsing step.

20 Claims, 1 Drawing Sheet

Specification includes a Sequence Listing.

(56) References Cited

U.S. PATENT DOCUMENTS

| | | | |
|---|---|---|---|
| 2015/0232827 | A1 | 8/2015 | Raab |
| 2016/0083703 | A1 | 3/2016 | Andersen |

FOREIGN PATENT DOCUMENTS

| | | | | | |
|---|---|---|---|---|---|
| FR | 2071237 | | | 9/1971 | |
| GB | 2247025 | A | | 2/1992 | |
| WO | 94/07984 | A1 | | 4/1994 | |
| WO | WO 95/10603 | | * | 4/1995 | ..... C12N 9/28 |
| WO | 2015/144780 | A2 | | 10/2015 | |
| WO | 2015/144782 | A1 | | 10/2015 | |
| WO | 2015/144932 | A1 | | 10/2015 | |
| WO | 2015/149641 | A1 | | 10/2015 | |
| WO | WO 2015/149641 | | * | 10/2015 | ..... C11D 3/386 |
| WO | WO 2016/001449 | | * | 1/2016 | ..... C12N 15/09 |

* cited by examiner

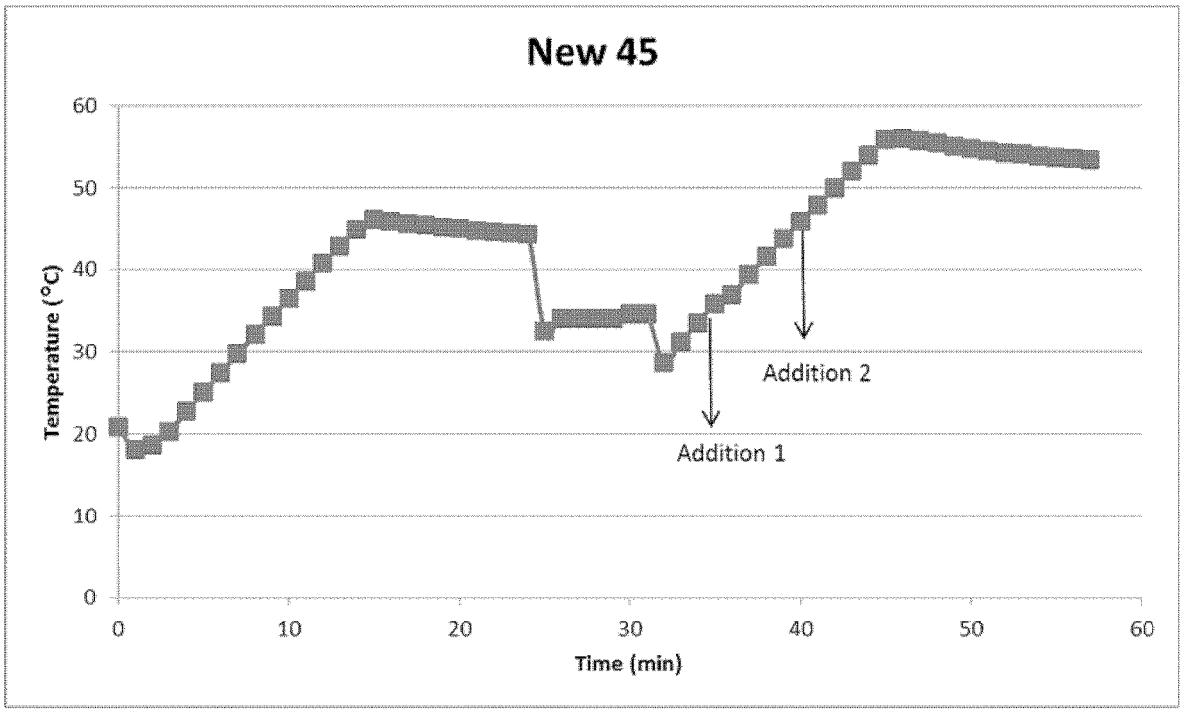
New 45
Temperature (°C)
60
50
40
30
20
10
0
0
10
20
30
40
50
60
Time (min)
Addition 1
Addition 2

USE OF ENZYMES, COMPOSITION AND METHOD FOR REMOVING SOIL

CROSS-REFERENCE TO RELATED APPLICATIONS

This application is a 35 U.S.C. 371 national application of international application no. PCT/EP2017/064673 filed Jun. 15, 2017, which claims priority or the benefit under 35 U.S.C. 119 of European application no. 16175968.3, filed Jun. 23, 2016, the contents of which are fully incorporated herein by reference.

FIELD OF THE INVENTION

The present invention concerns the use of enzymes for removing soil from a surface during the rising of the surface, wherein the rinsing is following a washing cycle. The invention further concerns a rinse aid composition for rinsing the surface and a method for removing soil from the surface during a rinsing step.

REFERENCE TO A SEQUENCE LISTING

This application contains a Sequence Listing in computer readable form. The computer readable form is incorporated herein by reference.

BACKGROUND OF THE INVENTION

Use of enzymes in dishwashing detergents is well known in the field of both automatic dishwashing (ADW) formulas, and in hand dishwashing formulas. Typically proteases and amylases are used in commercial dishwashing detergents. These enzymes are useful for degrading protein and starch/amylose, respectively.

SUMMARY OF THE INVENTION

The present invention concerns the use of at least one enzyme and water for removing soil from a surface during rinsing of the surface, wherein the rinsing is following a washing cycle. Further is claimed a rinse aid composition comprising at least one enzyme, a non-ionic surfactant and an acid.

The invention also concerns a method for removing soil from a surface, wherein the method comprises the steps of:

(i) Exposing the surface to a wash liquor, and (ii) Rinsing the surface with water comprising at least one enzyme;

wherein the surface is a dishware or a hard surface.

BRIEF DESCRIPTION OF THE DRAWING

FIG. 1 shows the the temperature in the automatic dish wash machine versus the washing time.

Definitions

Dishware: The term dish ware is intended to mean any form of kitchen utensil, dinner set or tableware such as but not limited to pans, plates, cops, knives, forks, spoons, porcelain etc.

Dish wash: The term "dish wash" refers to all forms of washing dishes, e.g. by hand (MDW) or automatic dish wash (ADW). Washing dishes includes, but is not limited to, the cleaning of all forms of crockery such as plates, cups, glasses, bowls, all forms of cutlery such as spoons, knives, forks and serving utensils as well as ceramics, plastics, metals, china, glass and acrylics.

Dish washing composition: The term "dish washing composition" refers to compositions intended for cleaning dishware such as plates, cups, glasses, bowls, cutlery such as spoons, knives, forks, serving utensils, ceramics, plastics, metals, china, glass and acrylics in a dishwashing machine. The terms encompass any materials/compounds selected for household or industrial washing applications and the form of the product can be liquid, powder or granulate. In addition enzymes, the automatic dishwashing composition contains detergent components such as polymers, bleaching systems, bleach activators, bleach catalysts, silicates, dyestuff and metal care agents. The dishwashing composition can be use in manual dishwashing (MDW) or automatic dishwashing (ADW).

Hard surface cleaning: The term "Hard surface cleaning" is defined herein as cleaning of hard surfaces wherein hard surfaces may include floors, tables, walls, roofs etc. as well as surfaces of hard objects such as cars (car wash) and dishes (dish wash). Dish washing includes but are not limited to cleaning of plates, cups, glasses, bowls, cutlery such as spoons, knives, forks, serving utensils, ceramics, plastics, metals, china, glass and acrylics.

Sequence identity: The relatedness between two amino acid sequences or between two nucleotide sequences is described by the parameter "sequence identity".

For purposes of the present invention, the sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix. The output of Needle labeled "longest identity" (obtained using the –nobrief option) is used as the percent identity and is calculated as follows:

(Identical Residues×100)/(Length of Alignment−Total Number of Gaps in Alignment)

For purposes of the present invention, the sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra), preferably version 5.0.0 or later. The parameters used are gap open penalty of 10, gap extension penalty of 0.5, and the EDNAFULL (EMBOSS version of NCBI NUC4.4) substitution matrix. The output of Needle labeled "longest identity" (obtained using the –nobrief option) is used as the percent identity and is calculated as follows:

(Identical Deoxyribonucleotides×100)/(Length of Alignment−Total Number of Gaps in Alignment)

Variant: The term "variant" means a polypeptide having enzyme activity comprising an alteration, i.e., a substitution, insertion, and/or deletion, at one or more (e.g., several) positions. A substitution means replacement of the amino acid occupying a position with a different amino acid; a deletion means removal of the amino acid occupying a position; and an insertion means adding an amino acid adjacent to and immediately following the amino acid occupying a position.

Wash cycle: The term "wash cycle" is defined herein as a washing operation wherein dishware are exposed to the wash liquor for a period of time by circulating the wash liquor and spraying the wash liquor onto the dishware in order to clean the dishware and finally the superfluous wash liquor is removed. A wash cycle may be repeated one, two, three, four, five or even six times at the same or at different temperatures. Hereafter the dishware is generally rinsed and dried. One of the wash cycles can be a soaking step, where the dishware is left soaking in the wash liquor for a period.

Rinse cycle: The term "rinse cycle" is defined herein a step carried out after the wash cycle, and where the dishware is rinsed with water or water comprising a rinse aid for a period of time. A rinse cycle may be repeated one or two times at the same or at different temperatures.

Rinse aid:

Wash liquor: The term "wash liquor" is intended to mean the solution or mixture of water and detergents optionally including enzymes used for dishwashing.

DETAILED DESCRIPTION OF THE INVENTION

The invention concerns use of at least one enzyme and water for removing soil from a surface during rinsing of the surface, wherein the rinsing is following a washing cycle. The invention further concerns a rinse aid composition comprising at least one enzyme, a non-ionic surfactant and an acid. The composition can be granular or liquid. The liquid rinse aid composition can have a pH in the range of 1-7 such as in the in the range of 2-6 or in the range of 2-4 or in the range of 2.5-3.5. The rinse aid can be used for facilitating the rinsing the surface. Also is claimed a method for removing soil from a surface, wherein the method comprises the steps of:

(i) Exposing the surface to a wash liquor, and (ii) Rinsing the hard surface with water comprising at least one enzyme;

wherein the surface is a dishware or a hard surface.

In one embodiment the wash liquor is removed before step (ii). The rinsing step (ii) can comprise more than one rinsing step such as two or three rinsing steps. If there is more than one rinsing step the at least one enzyme is comprised in the water of at least one of the rinsing steps. The rinse aid composition of the invention can be used in the method.

In one embodiment the invention the surface is a dish ware or a hard surface present in a dishwashing machine. The hard surface is present in the interior of a dishwashing machine such as walls, baskets, nozzles, pumps, sump, filters, pipelines, drains, and outlets.

The enzymes can be used in a process for automatic dish washing.

Use of enzymes for washing surfaces are commonly know. For example in dishwashing applications, enzymes can be used in the washing cycle in order to facilitate the removal of soil from the surface of the dishware and the interior of the dishwashing machine. The inventors have surpassingly found that by using enzymes during the rinsing step of a washing process the removal of soil is improved and for some enzymes even better than when the enzymes are used during the washing cycle.

Removal of soil from dishware is off course of importance as the consumer would like clean dishware. However cleaning of the interior of the dishwashing machine is also important because soil left in the dishwashing machine may cause malodor. Especially soil remained and accumulated in the filter, drain and sump can give rise to malodor. The use of enzymes in the rinsing step can reduce this problem as the enzymes are more likely to be present in the drain and sump after wash than the enzymes used during the wash cycle.

One way of measuring the removal of soil is by Assay I or Assay II as described herein. The inventors have found that the present invention reduces the soil by at least 70% when measured with Assay I or has a score above 7 when measured with Assay II. In one embodiment of the invention the soil is reduced by at least 75%, at least 80%, at least 90%, at least 95%, at least 96%, at least 97%, at least 98% or at least 99% when measured with Assay I. In one embodiment of the invention the score is above 7.5, above 8.0, above 8.5, above 9.0 or even above 9.5 when measured with Assay II.

According to the invention at least one enzymes is used during the rinsing of the surface. The enzyme can be selected from the group consisting of hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, R-glucanases, arabinosidases, hyaluronidase, chondroitinase, laccase, DNase chlorophyllases, amylases, perhydrolases, peroxidases, xanthanase and mixtures thereof.

The invention also concerns a rinse aid composition comprising at least one enzyme, a non-ionic surfactant and an acid. The rinse aid composition can be, wherein the composition has a pH in the range of 1-7. The composition can be a rinse aid. Rinse aids are commonly known to be used in automatic dishwashing (ADW) processes. The rinse aids are automatically dosed by the dishwashing machine and it helps remove water from the dishware and makes the dishware bright and shining.

In one embodiment of the invention the rinse aid composition comprises a non-ionic surfactant in an amount below 15% (w/w). In one embodiment the composition comprises a non-ionic surfactant in the range of 5-15%, in the range of 8-15%, in the range of 10-15%, in the range of 5-10% or in the range of 5-8% (all percentages are w/w %).

The non-ionic surfactant can be alcohol alkoxylates and/or biobased surfactants.

The alcohol alkoxylates are selected from the group consisting of epoxy-capped poly(oxyalkylated) alcohols and alcohol ethoxylates with linear radicals formed from alcohols of native origin having 12 to 18 carbon atoms. the alcohol alkoxylates can be alkoxylated primary alcohols having preferably 8 to 18 carbon atoms and an average of 1 to 20, preferably 1 to 12, mol of ethylene oxide (E0) per mole of alcohol, in which the alcohol radical may be linear or preferably 2-methyl-branched, or may comprise linear and methyl-branched radicals in a mixture. The alcohol alkoxylates are described in further details below.

The composition may further comprise a preservative and/or biocide. The preservative and/or biocide is selected from metholisothiazolinone or methylchlorisothiazolinone or a combination of metholisothiazolinone and methylchlorisothiazolinone. Metholisothiazolinone and methylchlorisothiazolinone have preserving effect and biocidal effect.

The compositions herein may additionally include an acid. Any suitable organic and/or inorganic acid in any suitable amount may be used in the rinse aid compositions and/or products. Some suitable acids include, but are not limited to acids selected from the group consisting of acetic acid, aspartic acid, benzoic acid, boric acid, bromic acid, citric acid, formic acid, gluconic acid, glutamic acid, lactic acid, malic acid, nitric acid, sulfamic acid, sulfuric acid, tartaric acid, and mixtures thereof.

In the case of a liquid rinse aid composition, adding an acid to the rinse aid composition enables water-soluble metal salts to at least partially dissolve in the composition. The acid also helps to at least partially reduce the precipitation on hard surfaces during the rinse cycle. The acid may also stabilize the liquid rinse aid composition against precipitation in the product prior to use. In the case of a solid rinse aid composition, adding an acid to the rinse aid composition enables water-soluble metal salts, once released, to at least partially dissolve quickly in the wash and/or rinse liquor of an automatic dishwashing appliance so as to prevent insoluble material from forming and/or from depositing onto hard surfaces, such as on flatware, glasses, dishes and/or components inside the automatic dishwashing appliance itself. In one embodiment of the invention the composition can further comprise a glass care ingredient such as zinc acetate, zinc chloride and bismuth.

In one embodiment the composition can comprise 75-80% water, 5-15% non-ionic surfactant, sodium- or potassium cumentesulfonate, citric acid, zinc acetate, metholisothiazolinone and methylchlorisothiazolinone and an amylase.

In one embodiment the composition can comprise 75-80% water, 5-15% non-ionic surfactant, sodium- or potassium cumentesulfonate, citric acid, zinc acetate, metholisothiazolinone and methylchlorisothiazolinone and an amylase and a protease.

The composition of the invention does not comprise bleaching agents.

In one embodiment of the invention the enzyme is an amylase, which amylase is an alpha-amylase or a glucoamylase.

In one embodiment the amylase has at least 80% sequence identity to SEQ ID NO: 1, such as at least 85% sequence identity to SEQ ID NO: 1, at least 90% sequence identity to SEQ ID NO: 1, at least 95% sequence identity to SEQ ID NO: 1, at least 96% sequence identity to SEQ ID NO: 1, at least 97% sequence identity to SEQ ID NO: 1, at least 98% sequence identity to SEQ ID NO: 1 or at least 99% sequence identity to SEQ ID NO: 1.

In one embodiment the amylase has at least 80% sequence identity to SEQ ID NO: 2, such as at least 85% sequence identity to SEQ ID NO: 2, at least 90% sequence identity to SEQ ID NO: 2, at least 95% sequence identity to SEQ ID NO: 2, at least 96% sequence identity to SEQ ID NO: 2, at least 97% sequence identity to SEQ ID NO: 2, at least 98% sequence identity to SEQ ID NO: 2 or at least 99% sequence identity to SEQ ID NO: 2.

In one embodiment of the invention the enzyme is a protease, which protease is a serine protease or a metalloprotease, preferably an alkaline microbial protease or a trypsin-like protease.

In one embodiment of the invention the protease has at least 80% sequence identity to SEQ ID NO: 3, such as at least 85% sequence identity to SEQ ID NO: 3, at least 90% sequence identity to SEQ ID NO: 3, at least 95% sequence identity to SEQ ID NO: 3, at least 96% sequence identity to SEQ ID NO: 3, at least 97% sequence identity to SEQ ID NO: 3, at least 98% sequence identity to SEQ ID NO: 3 or at least 99% sequence identity to SEQ ID NO: 3.

In one embodiment of the invention the protease has at least 80% sequence identity to SEQ ID NO: 4, such as at least 85% sequence identity to SEQ ID NO: 4, at least 90% sequence identity to SEQ ID NO: 4, at least 95% sequence identity to SEQ ID NO: 4, at least 96% sequence identity to SEQ ID NO: 4, at least 97% sequence identity to SEQ ID NO: 4, at least 98% sequence identity to SEQ ID NO: 4 or at least 99% sequence identity to SEQ ID NO: 4.

In one embodiment the amylase has at least 80% sequence identity to SEQ ID NO: 5, such as at least 85% sequence identity to SEQ ID NO: 5, at least 90% sequence identity to SEQ ID NO: 5, at least 95% sequence identity to SEQ ID NO: 5, at least 96% sequence identity to SEQ ID NO: 5, at least 97% sequence identity to SEQ ID NO: 5, at least 98% sequence identity to SEQ ID NO: 5 or at least 99% sequence identity to SEQ ID NO: 5.

In one embodiment of the invention one or more enzymes are used in addition to the at least one enzyme used in the rinsing of a surface. The one or more enzymes can be selected from the group consisting of hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, R-glucanases, arabinosidases, hyaluronidase, chondroitinase, laccase, DNase chlorophyllases, amylases, perhydrolases, peroxidases, xanthanase and mixtures thereof. The enzymes are described in further details below.

In one embodiment of the invention amylase and protease are used when rinsing the surface e.g. by being comprised in the same rinse aid composition. In one embodiment the amylase amylase has at least 80% sequence identity to SEQ ID NO: 1 and is used together with a protease having at least 80% sequence identity to SEQ ID NO: 3. In one embodiment the amylase amylase has at least 80% sequence identity to SEQ ID NO: 1 and is used together with a protease having at least 80% sequence identity to SEQ ID NO: 4. In one embodiment the amylase amylase has at least 80% sequence identity to SEQ ID NO: 1 and is used together with a protease having at least 80% sequence identity to SEQ ID NO: 5. In one embodiment the amylase amylase has at least 80% sequence identity to SEQ ID NO: 2 and is used together with a protease having at least 80% sequence identity to SEQ ID NO: 3. In one embodiment the amylase amylase has at least 80% sequence identity to SEQ ID NO: 2 and is used together with a protease having at least 80% sequence identity to SEQ ID NO: 4. In one embodiment the amylase amylase has at least 80% sequence identity to SEQ ID NO: 2 and is used together with a protease having at least 80% sequence identity to SEQ ID NO: 5.

In one embodiment of the invention amylase and protease are used when rinsing the surface e.g. by being comprised in the same rinse aid composition. In one embodiment the amylase amylase has at least 85% sequence identity to SEQ ID NO: 1 and is used together with a protease having at least 85% sequence identity to SEQ ID NO: 3. In one embodiment the amylase amylase has at least 85% sequence identity to SEQ ID NO: 1 and is used together with a protease having at least 85% sequence identity to SEQ ID NO: 4. In one embodiment the amylase amylase has at least 85% sequence identity to SEQ ID NO: 1 and is used together with a protease having at least 85% sequence identity to SEQ ID NO: 5. In one embodiment the amylase amylase has at least 85% sequence identity to SEQ ID NO: 2 and is used together with a protease having at least 80% sequence identity to SEQ ID NO: 3. In one embodiment the amylase amylase has at least 85% sequence identity to SEQ ID NO: 2 and is used together with a protease having at least 85% sequence identity to SEQ ID NO: 4. In one embodiment the amylase amylase has at least 85% sequence identity to SEQ ID NO: 2 and is used together with a protease having at least 85% sequence identity to SEQ ID NO: 5.

In one embodiment of the invention amylase and protease are used when rinsing the surface e.g. by being comprised in the same rinse aid composition. In one embodiment the amylase amylase has at least 90% sequence identity to SEQ ID NO: 1 and is used together with a protease having at least 90% sequence identity to SEQ ID NO: 3. In one embodiment the amylase amylase has at least 90% sequence identity to SEQ ID NO: 1 and is used together with a protease having at least 90% sequence identity to SEQ ID NO: 4. In one embodiment the amylase amylase has at least 90% sequence identity to SEQ ID NO: 1 and is used together with a protease having at least 90% sequence identity to SEQ ID NO: 5. In one embodiment the amylase amylase has at least 90% sequence identity to SEQ ID NO: 2 and is used together with a protease having at least 90% sequence identity to SEQ ID NO: 3. In one embodiment the amylase amylase has at least 90% sequence identity to SEQ ID NO: 2 and is used together with a protease having at least 90% sequence identity to SEQ ID NO: 4. In one embodiment the amylase amylase has at least 90% sequence identity to SEQ ID NO: 2 and is used together with a protease having at least 90% sequence identity to SEQ ID NO: 5.

In one embodiment of the invention amylase and protease are used when rinsing the surface e.g. by being comprised in the same rinse aid composition. In one embodiment the amylase amylase has at least 95% sequence identity to SEQ ID NO: 1 and is used together with a protease having at least 95% sequence identity to SEQ ID NO: 3. In one embodiment the amylase amylase has at least 95% sequence identity to SEQ ID NO: 1 and is used together with a protease having at least 95% sequence identity to SEQ ID NO: 4. In one embodiment the amylase amylase has at least 95% sequence identity to SEQ ID NO: 1 and is used together with a protease having at least 95% sequence identity to SEQ ID NO: 5. In one embodiment the amylase amylase has at least 95% sequence identity to SEQ ID NO: 2 and is used together with a protease having at least 95% sequence identity to SEQ ID NO: 3. In one embodiment the amylase amylase has at least 95% sequence identity to SEQ ID NO: 2 and is used together with a protease having at least 95% sequence identity to SEQ ID NO: 4. In one embodiment the amylase amylase has at least 95% sequence identity to SEQ ID NO: 2 and is used together with a protease having at least 95% sequence identity to SEQ ID NO: 5.

In one embodiment of the invention amylase and protease are used when rinsing the surface e.g. by being comprised in the same rinse aid composition. In one embodiment the amylase amylase has at least 99% sequence identity to SEQ ID NO: 1 and is used together with a protease having at least 99% sequence identity to SEQ ID NO: 3. In one embodiment the amylase amylase has at least 99% sequence identity to SEQ ID NO: 1 and is used together with a protease having at least 99% sequence identity to SEQ ID NO: 4. In one embodiment the amylase amylase has at least 99% sequence identity to SEQ ID NO: 1 and is used together with a protease having at least 99% sequence identity to SEQ ID NO: 5. In one embodiment the amylase amylase has at least 99% sequence identity to SEQ ID NO: 2 and is used together with a protease having at least 99% sequence identity to SEQ ID NO: 3. In one embodiment the amylase amylase has at least 99% sequence identity to SEQ ID NO: 2 and is used together with a protease having at least 99% sequence identity to SEQ ID NO: 4. In one embodiment the amylase amylase has at least 99% sequence identity to SEQ ID NO: 2 and is used together with a protease having at least 99% sequence identity to SEQ ID NO: 5.

Suitable amylases which can be used in the rinse aid composition of the invention may be an alpha-amylase or a glucoamylase and may be of bacterial or fungal origin. Chemically modified or protein engineered mutants are included. Amylases include, for example, alpha-amylases obtained from *Bacillus*, e.g., a special strain of *Bacillus licheniformis*, described in more detail in GB 1,296,839.

Suitable amylases include amylases having SEQ ID NO: 2 in WO 95/10603 or variants having 90% sequence identity to SEQ ID NO: 3 thereof. Preferred variants are described in WO 94/02597, WO 94/18314, WO 97/43424 and SEQ ID NO: 4 of WO 99/019467, such as variants with substitutions in one or more of the following positions: 15, 23, 105, 106, 124, 128, 133, 154, 156, 178, 179, 181, 188, 190, 197, 201, 202, 207, 208, 209, 211, 243, 264, 304, 305, 391, 408, and 444.

Different suitable amylases include amylases having SEQ ID NO: 6 in WO 02/010355 or variants thereof having 90% sequence identity to SEQ ID NO: 6. Preferred variants of SEQ ID NO: 6 are those having a deletion in positions 181 and 182 and a substitution in position 193.

Other amylases which are suitable are hybrid alpha-amylase comprising residues 1-33 of the alpha-amylase derived from *B. amyloliquefaciens* shown in SEQ ID NO: 6 of WO 2006/066594 and residues 36-483 of the *B. licheniformis* alpha-amylase shown in SEQ ID NO: 4 of WO 2006/066594 or variants having 90% sequence identity thereof. Preferred variants of this hybrid alpha-amylase are those having a substitution, a deletion or an insertion in one of more of the following positions: G48, T49, G107, H156, A181, N190, M197, I201, A209 and Q264. Most preferred variants of the hybrid alpha-amylase comprising residues 1-33 of the alpha-amylase derived from *B. amyloliquefaciens* shown in SEQ ID NO: 6 of WO 2006/066594 and residues 36-483 of SEQ ID NO: 4 are those having the substitutions: M197T; H156Y+A181T+N190F+A209V+Q264S; or G48A+T49I+G107A+H156Y+A181T+N190F+1201F+A209V+Q264S.

Further amylases which are suitable are amylases having SEQ ID NO: 6 in WO 99/019467 or variants thereof having 90% sequence identity to SEQ ID NO: 6. Preferred variants of SEQ ID NO: 6 are those having a substitution, a deletion or an insertion in one or more of the following positions: R181, G182, H183, G184, N195, I206, E212, E216 and K269. Particularly preferred amylases are those having deletion in positions R181 and G182, or positions H183 and G184.

Additional amylases which can be used are those having SEQ ID NO: 1, SEQ ID NO: 3, SEQ ID NO: 2 or SEQ ID NO: 7 of WO 96/023873 or variants thereof having 90% sequence identity to SEQ ID NO: 1, SEQ ID NO: 2, SEQ ID NO: 3 or SEQ ID NO: 7. Preferred variants of SEQ ID NO: 1, SEQ ID NO: 2, SEQ ID NO: 3 or SEQ ID NO: 7 are those having a substitution, a deletion or an insertion in one or more of the following positions: 140, 181, 182, 183, 184, 195, 206, 212, 243, 260, 269, 304 and 476, using SEQ ID 2 of WO 96/023873 for numbering. More preferred variants are those having a deletion in two positions selected from 181, 182, 183 and 184, such as 181 and 182, 182 and 183, or positions 183 and 184. Most preferred amylase variants of SEQ ID NO: 1, SEQ ID NO: 2 or SEQ ID NO: 7 are those having a deletion in positions 183 and 184 and a substitution in one or more of positions 140, 195, 206, 243, 260, 304 and 476.

Other amylases which can be used are amylases having SEQ ID NO: 2 of WO 08/153815, SEQ ID NO: 10 in WO 01/66712 or variants thereof having 90% sequence identity to SEQ ID NO: 2 of WO 08/153815 or 90% sequence identity to SEQ ID NO: 10 in WO 01/66712. Preferred variants of SEQ ID NO: 10 in WO 01/66712 are those having a substitution, a deletion or an insertion in one of more of the following positions: 176, 177, 178, 179, 190, 201, 207, 211 and 264.

Further suitable amylases are amylases having SEQ ID NO: 2 of WO 09/061380 or variants having 90% sequence identity to SEQ ID NO: 2 thereof. Preferred variants of SEQ ID NO: 2 are those having a truncation of the C-terminus and/or a substitution, a deletion or an insertion in one of more of the following positions: Q87, Q98, S125, N128, T131, T165, K178, R180, S181, T182, G183, M201, F202, N225, S243, N272, N282, Y305, R309, D319, Q320, Q359, K444 and G475. More preferred variants of SEQ ID NO: 2 are those having the substitution in one of more of the following positions: Q87E,R, Q98R, S125A, N128C, T131I, T165I, K178L, T182G, M201L, F202Y, N225E,R, N272E, R, S243Q,A,E,D, Y305R, R309A, Q320R, Q359E, K444E and G475K and/or deletion in position R180 and/or S181 or of T182 and/or G183. Most preferred amylase variants of SEQ ID NO: 2 are those having the substitutions:

N128C+K178L+T182G+Y305R+G475K;

N128C+K178L+T182G+F202Y+Y305R+D319T+G475K;

S125A+N128C+K178L+T182G+Y305R+G475K; or

S125A+N128C+T131I+T165I+K178L+T182G+Y305R+G475K wherein the variants are C-terminally truncated and optionally further comprises a substitution at position 243 and/or a deletion at position 180 and/or position 181.

Further suitable amylases are amylases having SEQ ID NO: 1 of WO13184577 or variants having 90% sequence identity to SEQ ID NO: 1 thereof. Preferred variants of SEQ ID NO: 1 are those having a substitution, a deletion or an insertion in one of more of the following positions: K176, R178, G179, T180, G181, E187, N192, M199, I203, S241, R458, T459, D460, G476 and G477. More preferred variants of SEQ ID NO: 1 are those having the substitution in one of more of the following positions: K176L, E187P, N192FYH, M199L, 1203YF, S241QADN, R458N, T459S, D460T, G476K and G477K and/or deletion in position R178 and/or S179 or of T180 and/or G181. Most preferred amylase variants of SEQ ID NO: 1 are those having the substitutions:

E187P+1203Y+G476K

E187P+1203Y+R458N+T459S+D460T+G476K wherein the variants optionally further comprises a substitution at position 241 and/or a deletion at position 178 and/or position 179.

Further suitable amylases are amylases having SEQ ID NO: 1 of WO10104675 or variants having 90% sequence identity to SEQ ID NO: 1 thereof. Preferred variants of SEQ ID NO: 1 are those having a substitution, a deletion or an insertion in one of more of the following positions: N21, D97, V128I K177, R179, S180, I181, G182, M200, L204, E242, G477 and G478. More preferred variants of SEQ ID NO: 1 are those having the substitution in one of more of the following positions: N21D, D97N, V128I K177L, M200L, L204YF, E242QA, G477K and G478K and/or deletion in position R179 and/or S180 or of I181 and/or G182. Most preferred amylase variants of SEQ ID NO: 1 are those having the substitutions:

N21D+D97N+V128I wherein the variants optionally further comprises a substitution at position 200 and/or a deletion at position 180 and/or position 181.

Other suitable amylases are the alpha-amylase having SEQ ID NO: 12 in WO01/66712 or a variant having at least 90% sequence identity to SEQ ID NO: 12. Preferred amylase variants are those having a substitution, a deletion or an insertion in one of more of the following positions of SEQ ID NO: 12 in WO01/66712: R28, R118, N174; R181, G182, D183, G184, G186, W189, N195, M202, Y298, N299, K302, S303, N306, R310, N314; R320, H324, E345, Y396, R400, W439, R444, N445, K446, Q449, R458, N471, N484. Particular preferred amylases include variants having a deletion of D183 and G184 and having the substitutions R118K, N195F, R320K and R458K, and a variant additionally having substitutions in one or more position selected from the group: M9, G149, G182, G186, M202, T257, Y295, N299, M323, E345 and A339, most preferred a variant that additionally has substitutions in all these positions.

Other examples are amylase variants such as those described in WO2011/098531, WO2013/001078 and WO2013/001087.

Commercially available amylases are Duramyl™, Termamyl™, Fungamyl™, Stainzyme™, Stainzyme Plus™, Natalase™, Liquozyme X and BAN™ (from Novozymes NS), and Rapidase™, Purastar™/Effectenz™, Powerase, Preferenz S1000, Preferenz S100 and Preferenz S110 (from Genencor International Inc./DuPont).

Suitable proteases include those of bacterial, fungal, plant, viral or animal origin e.g. vegetable or microbial origin. Microbial origin is preferred. Chemically modified or protein engineered mutants are included. It may be an alkaline protease, such as a serine protease or a metalloprotease. A serine protease may for example be of the 51 family, such as trypsin, or the S8 family such as subtilisin. A metalloproteases protease may for example be a thermolysin from e.g. family M4 or other metalloprotease such as those from M5, M7 or M8 families.

The term "subtilases" refers to a sub-group of serine protease according to Siezen et al., Protein Engng. 4 (1991) 719-737 and Siezen et al. Protein Science 6 (1997) 501-523. Serine proteases are a subgroup of proteases characterized by having a serine in the active site, which forms a covalent adduct with the substrate. The subtilases may be divided into 6 sub-divisions, i.e. the Subtilisin family, the Thermitase family, the Proteinase K family, the Lantibiotic peptidase family, the Kexin family and the Pyrolysin family.

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO09/021867, and subtilisin *lentus*, subtilisin Novo, subtilisin Carlsberg, *Bacillus licheniformis*, subtilisin BPN', subtilisin 309, subtilisin 147 and subtilisin 168 described in WO89/06279 and protease PD138 described in (WO93/18140). Other useful proteases may be those described in WO92/175177, WO01/016285, WO02/026024 and WO02/016547. Examples of trypsin-like proteases are trypsin (e.g. of porcine or bovine origin) and the *Fusarium* protease described in WO89/06270, WO94/25583 and WO05/040372, and the chymotrypsin proteases derived from *Cellumonas* described in WO05/052161 and WO05/052146.

A further preferred protease is the alkaline protease from *Bacillus lentus* DSM 5483, as described for example in WO95/23221, and variants thereof which are described in WO92/21760, WO95/23221, EP1921147 and EP1921148.

Examples of metalloproteases are the neutral metalloprotease as described in WO07/044993 (Genencor Int.) such as those derived from *Bacillus amyloliquefaciens*.

Examples of useful proteases are the variants described in: WO92/19729, WO96/034946, WO98/20115, WO98/20116, WO99/011768, WO01/44452, WO03/006602, WO04/03186, WO04/041979, WO07/006305, WO11/036263, WO11/036264, especially the variants with substitutions in one or more of the following positions: 3, 4, 9, 15, 24, 27, 42, 55, 59, 60, 66, 74, 85, 96, 97, 98, 99, 100, 101, 102, 104, 116, 118, 121, 126, 127, 128, 154, 156, 157, 158, 161, 164, 176, 179, 182, 185, 188, 189, 193, 198, 199, 200, 203, 206, 211, 212, 216, 218, 226, 229, 230, 239, 246, 255, 256, 268 and 269 wherein the positions correspond to the positions of the *Bacillus Lentus* protease shown in SEQ ID NO 1 of WO 2016/001449. More preferred the subtilase variants may comprise the mutations: S3T, V41, S9R, S9E, A15T, S24G, S24R, K27R, N42R, S55P, G59E, G59D, N60D, N60E, V66A, N74D, N85S, N85R, G96S, G96A, S97G, S97D, S97A, S97SD, S99E, S99D, S99G, S99M, S99N, S99R, S99H, S101A, V1021, V102Y, V102N, S104A, G116V, G116R, H118D, H118N, N120S, S126L, P127Q, S128A, S154D, A156E, G157D, G157P, S158E, Y161A, R164S, Q176E, N179E, S182E, Q185N, A188P, G189E, V193M, N198D, V199I, Y203W, S206G, L211Q, L211D, N212D, N212S, M216S, A226V, K229L, Q230H, Q239R, N246K, N255W, N255D, N255E, L256E, L256D T268A, R269H. The protease variants are preferably variants of the *Bacillus Lentus* protease (Savinase®) shown in SEQ ID NO 1 of WO 2016/001449, the *Bacillus amyloliquefaciens* protease (BPN') shown in SEQ ID NO 2 of WO2016/001449. The protease variants preferably have at least 80% sequence identity to SEQ ID NO 1 or SEQ ID NO 2 of WO 2016/001449.

A protease variant comprising a substitution at one or more positions corresponding to positions 171, 173, 175, 179, or 180 of SEQ ID NO: 1 of WO2004/067737, wherein said protease variant has a sequence identity of at least 75% but less than 100% to SEQ ID NO: 1 of WO2004/067737.

Suitable commercially available protease enzymes include those sold under the trade names Alcalase®, Duralase™, Durazym™, Relase®, Relase® Ultra, Savinase®, Savinase® Ultra, Primase®, Polarzyme®, Kannase®, Liquanase®, Liquanase® Ultra, Ovozyme®, Coronase®, Coronase® Ultra, Blaze®, Blaze Evity® 100T, Blaze Evity® 125T, Blaze Evity® 150T, Neutrase®, Everlase® and Esperase® (Novozymes NS), those sold under the tradename Maxatase®, Maxacal®, Maxapem®, Purafect Ox®, Purafect OxP®, Puramax®, FN2®, FN3®, FN4®, Excellase®, Excellenz P1000™, Excellenz P1250™, Eraser®, Preferenz P100™, Purafect Prime®, Preferenz P110™, Effectenz P1000™, Purafect®™, Effectenz P1050™, Purafect Ox®™, Effectenz P2000™, Purafast®, Properase®, Opticlean® and Optimase® (Danisco/DuPont), Axapem™ (Gist-Brocases N.V.), BLAP (sequence shown in FIG. 29 of U.S. Pat. No. 5,352,604) and variants hereof (Henkel AG) and KAP (*Bacillus alkalophilus* subtilisin) from Kao.

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. Nos. 4,435,307, 5,648,263, 5,691,178, 5,776,757 and WO 89/09259.

Especially suitable cellulases are the alkaline or neutral cellulases having colour care benefits. Examples of such cellulases are cellulases described in EP 0 495 257, EP 0 531 372, WO 96/11262, WO 96/29397, WO 98/08940. Other examples are cellulase variants such as those described in WO 94/07998, EP 0 531 315, U.S. Pat. Nos. 5,457,046, 5,686,593, 5,763,254, WO 95/24471, WO 98/12307 and WO99/001544.

Other cellulases are endo-beta-1,4-glucanase enzyme having a sequence of at least 97% identity to the amino acid sequence of position 1 to position 773 of SEQ ID NO:2 of WO 2002/099091 or a family 44 xyloglucanase, which a xyloglucanase enzyme having a sequence of at least 60% identity to positions 40-559 of SEQ ID NO: 2 of WO 2001/062903.

Commercially available cellulases include Celluzyme™, and Carezyme™ (Novozymes NS) Carezyme Premium™ (Novozymes NS), Celluclean™ (Novozymes NS), Celluclean Classic™ (Novozymes NS), Cellusoft™ (Novozymes NS), Whitezyme™ (Novozymes NS), Clazinase™, and Puradax HA™ (Genencor International Inc.), and KAC-500(B)™ (Kao Corporation).

Suitable mannanases include those of bacterial or fungal origin. Chemically or genetically modified mutants are included. The mannanase may be an alkaline mannanase of Family 5 or 26. It may be a wild-type from *Bacillus* or *Humicola*, particularly *B. agaradhaerens, B. licheniformis, B. halodurans, B. clausii*, or *H. insolens*. Suitable mannanases are described in WO 1999/064619. A commercially available mannanase is Mannaway (Novozymes NS).

Suitable peroxidases/oxidases include those of plant, bacterial or fungal origin. Chemically modified or protein engineered mutants are included. Examples of useful peroxidases include peroxidases from *Coprinus*, e.g., from *C. cinereus*, and variants thereof as those described in WO 93/24618, WO 95/10602, and WO 98/15257. Commercially available peroxidases include Guardzyme™ (Novozymes NS).

Suitable lipases and cutinases include those of bacterial or fungal origin. Chemically modified or protein engineered mutant enzymes are included. Examples include lipase from *Thermomyces*, e.g. from *T. lanuginosus* (previously named *Humicola lanuginosa*) as described in EP258068 and EP305216, cutinase from *Humicola*, e.g. *H. insolens* (WO96/13580), lipase from strains of *Pseudomonas* (some of these now renamed to *Burkholderia*), e.g. *P. alcaligenes* or *P. pseudoalcaligenes* (EP218272), *P. cepacia* (EP331376), P. sp. strain SD705 (WO95/06720 & WO96/27002), *P. wisconsinensis* (WO96/12012), GDSL-type *Streptomyces* lipases (WO10/065455), cutinase from *Magnaporthe grisea* (WO10/107560), cutinase from *Pseudomonas mendocina* (U.S. Pat. No. 5,389,536), lipase from *Thermobifida fusca* (WO11/084412), *Geobacillus stearothermophilus* lipase (WO11/084417), lipase from *Bacillus subtilis* (WO11/084599), and lipase from *Streptomyces griseus* (WO11/150157) and *S. pristinaespiralis* (WO12/137147).

Other examples are lipase variants such as those described in EP407225, WO92/05249, WO94/01541, WO94/25578, WO95/14783, WO95/30744, WO95/35381, WO95/22615, WO96/00292, WO97/04079, WO97/07202, WO00/34450, WO00/60063, WO01/92502, WO07/87508 and WO09/109500.

Preferred commercial lipase products include include Lipolase™, Lipex™; Lipolex™ and Lipoclean™ (Novozymes NS), Lumafast (originally from Genencor) and Lipomax (originally from Gist-Brocades).

Still other examples are lipases sometimes referred to as acyltransferases or perhydrolases, e.g. acyltransferases with homology to *Candida antarctica* lipase A (WO10/111143), acyltransferase from *Mycobacterium smegmatis* (WO05/56782), perhydrolases from the CE 7 family (WO09/67279), and variants of the *M. smegmatis* perhydrolase in particular the S54V variant used in the commercial product Gentle Power Bleach from Huntsman Textile Effects Pte Ltd (WO10/100028).

A peroxidase according to the invention is a peroxidase enzyme comprised by the enzyme classification EC 1.11.1.7, as set out by the Nomenclature Committee of the International Union of Biochemistry and Molecular Biology (IUBMB), or any fragment derived therefrom, exhibiting peroxidase activity.

Suitable peroxidases include those of plant, bacterial or fungal origin. Chemically modified or protein engineered mutants are included. Examples of useful peroxidases include peroxidases from *Coprinopsis*, e.g., from *C. cinerea* (EP 179,486), and variants thereof as those described in WO 93/24618, WO 95/10602, and WO 98/15257.

A peroxidase according to the invention also include a haloperoxidase enzyme, such as chloroperoxidase, bromoperoxidase and compounds exhibiting chloroperoxidase or bromoperoxidase activity. Haloperoxidases are classified according to their specificity for halide ions. Chloroperoxidases (E.C. 1.11.1.10) catalyze formation of hypochlorite from chloride ions.

In an embodiment, the haloperoxidase of the invention is a chloroperoxidase. Preferably, the haloperoxidase is a vanadium haloperoxidase, i.e., a vanadate-containing haloperoxidase. In a preferred method of the present invention the vanadate-containing haloperoxidase is combined with a source of chloride ion.

Haloperoxidases have been isolated from many different fungi, in particular from the fungus group dematiaceous hyphomycetes, such as *Caldariomyces*, e.g., *C. fumago, Alternaria, Curvularia*, e.g., *C. verruculosa* and *C. inaequalis, Drechslera, Ulocladium* and *Botrytis.*

Haloperoxidases have also been isolated from bacteria such as *Pseudomonas*, e.g., *P. pyrrocinia* and *Streptomyces*, e.g., *S. aureofaciens.*

In an preferred embodiment, the haloperoxidase is derivable from *Curvularia* sp., in particular *Curvularia verruculosa* or *Curvularia inaequalis*, such as *C. inaequalis* CBS 102.42 as described in WO 95/27046; or *C. verruculosa* CBS 147.63 or *C. verruculosa* CBS 444.70 as described in WO 97/04102; or from *Drechslera hartlebii* as described in WO 01/79459, *Dendryphiella salina* as described in WO 01/79458, *Phaeotrichoconis crotalarie* as described in WO 01/79461, or *Geniculosporium* sp. as described in WO 01/79460.

An oxidase according to the invention include, in particular, any laccase enzyme comprised by the enzyme classification EC 1.10.3.2, or any fragment derived therefrom exhibiting laccase activity, or a compound exhibiting a similar activity, such as a catechol oxidase (EC 1.10.3.1), an o-aminophenol oxidase (EC 1.10.3.4), or a bilirubin oxidase (EC 1.3.3.5).

Preferred laccase enzymes are enzymes of microbial origin. The enzymes may be derived from plants, bacteria or fungi (including filamentous fungi and yeasts).

Suitable examples from fungi include a laccase derivable from a strain of *Aspergillus, Neurospora*, e.g., *N. crassa, Podospora, Botrytis, Collybia, Fomes, Lentinus, Pleurotus, Trametes*, e.g., *T. villosa* and *T. versicolor, Rhizoctonia*, e.g., *R. solani, Coprinopsis*, e.g., *C. cinerea, C. comatus, C. friesii*, and *C. plicatilis, Psathyrella*, e.g., *P. condelleana, Panaeolus*, e.g., *P. papilionaceus, Myceliophthora*, e.g., *M. thermophila, Schytalidium*, e.g., *S. thermophilum, Polyporus*, e.g., *P. pinsitus, Phlebia*, e.g., *P. radiata* (WO 92/01046), or *Coriolus*, e.g., *C. hirsutus* (JP 2238885).

Suitable examples from bacteria include a laccase derivable from a strain of *Bacillus.*

A laccase derived from *Coprinopsis* or *Myceliophthora* is preferred; in particular a laccase derived from *Coprinopsis cinerea*, as disclosed in WO 97/08325; or from *Myceliophthora thermophila*, as disclosed in WO 95/33836.

Surfactants

The rinse aid composition of the invention can include at least one non-ionic surfactant. Suitable nonionic surfactants include, but are not limited to low-foaming nonionic (LFNI) surfactants. A LFNI surfactant is most typically used in an automatic dishwashing because of the improved water-sheeting action (especially from glassware) which they confer to the automatic dishwashing composition. They also may encompass non-silicone, phosphate or nonphosphate polymeric materials which are known to defoam food soils encountered in automatic dishwashing. The LFNI surfactant may have a relatively low cloud point and a high hydrophilic-lipophilic balance (HLB). Cloud points of 1% solutions in water are typically below about 32° C. and alternatively lower, e.g., 0° C., for optimum control of sudsing throughout a full range of water temperatures. If desired, a biodegradable LFNI surfactant having the above properties may be used.

A LFNI surfactant may include, but is not limited to: alkoxylated surfactants, especially ethoxylates derived from primary alcohols, and blends thereof with more sophisticated surfactants, such as the polyoxypropylene/polyoxyethylene/polyoxypropylene reverse block polymers. Suitable block polyoxyethylene-polyoxypropylene polymeric compounds that meet the requirements may include those based on ethylene glycol, propylene glycol, glycerol, trimethylolpropane and ethylenediamine, and mixtures thereof. Polymeric compounds made from a sequential ethoxylation and propoxylation of initiator compounds with a single reactive hydrogen atom, such as C12—is aliphatic alcohols, do not generally provide satisfactory suds control in Automatic dishwashing compositions. However, certain of the block polymer surfactant compounds designated as PLURONIC® and TETRONIC® by the BASF-Wyandotte Corp., Wyandotte, Mich., are suitable in Automatic dishwashing compositions.

The LFNI surfactant can optionally include a propylene oxide in an amount up to about 15% by weight. Other LFNI surfactants can be prepared by the processes described in U.S. Pat. No. 4,223,163. The LFNI surfactant may also be derived from a straight chain fatty alcohol containing from about 16 to about 20 carbon atoms (C16-C20 alcohol), alternatively a Ci8 alcohol, condensed with an average of from about 6 to about 15 moles, or from about 7 to about 12 moles, and alternatively, from about 7 to about 9 moles of ethylene oxide per mole of alcohol. The ethoxylated nonionic surfactant so derived may have a narrow ethoxylate distribution relative to the average.

In preferred embodiments, the surfactant is a non-ionic surfactant or a non-ionic surfactant system having a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and stability in product than single non-ionic surfactants. Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20. Preferably, the surfactant of formula I has at least about 10 carbon atoms in the terminal epoxide unit $[CH_2CH(OH)R_2]$. Suitable surfactants of formula I are Olin Corporation's POLY-TERGENT® SLF-18B nonionic surfactants, as described, for example, in WO 94/22800, published Oct. 13, 1994 by Olin Corporation.

Preferably non-ionic surfactants and/or system herein have a Draves wetting time of less than 360 seconds, preferably less than 200 seconds, more preferably less than 100 seconds and especially less than 60 seconds as measured by the Draves wetting method (standard method ISO 8022 using the following conditions; 3-g hook, 5-g cotton skein, 0.1% by weight aqueous solution at a temperature of 25° C.). Amine oxides surfactants are also useful in the present invention as anti-redeposition surfactants include linear and branched compounds having the formula:

$$R^3(OR^4)_x\,\overset{O^-}{\overset{|}{N^+}}(R^5)_2$$

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$-$C_{18}$ alkyl dimethylamine oxide, and $C_{10}$-$C_{18}$ acylamido alkyl dimethylamine oxide. Surfactants and especially non-ionic surfactants may be present in amounts from 0 to 10% by weight, preferably from 0.1% to 10%, and most preferably from 0.25% to 6%.

Other suitable nonionic surfactants can be oxidized thioethers of alcohol alkoxylates e.g. the oxidized thioethers described in international patent application WO12095481 (BASF).

The rinse aid of the composition can be used in industrial dish washing (ware washing).

The invention is further summarized in the following paragraphs:

1. Use of at least one enzyme and water for removing soil from a surface during rinsing of the surface wherein the rinsing is following a washing cycle.
2. Use according to paragraph 1, wherein the at least one enzyme is amylase.
3. Use according to paragraph 1, wherein the at least one enzyme is protease.
4. Use according to any paragraphs 1-3, wherein one or more enzymes are used in in addition to the at least one enzyme.
5. Use according to paragraph 4, wherein the one or more enzymes are selected from the group consisting of hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, R-glucanases, arabinosidases, hyaluronidase, chondroitinase, laccase, DNase chlorophyllases, amylases, perhydrolases, peroxidases, xanthanase and mixtures thereof.
6. Use according to any of the preceding paragraphs wherein the at least one enzyme is amylase and the one or more enzyme is protease.
7. Use according to any of the preceding paragraphs, wherein the soil is reduced by at least 70% when measured with Assay I or above 7 when measured with Assay II.
8. Use according to paragraph 10, wherein the soil is reduced by at least 75%, at least 80%, at least 90%, at least 95%, at least 96%, at least 97%, at least 98% or at least 99% when measured with Assay I.
9. Use according to any of the preceding paragraphs, wherein the surface is a dish ware or a hard surface present in a dishwashing machine.
10. Use according to paragraph 9, wherein the hard surface is present in the interior of a dishwashing machine, such as walls, baskets, nozzles, pumps, sump, filters, pipelines, drains, and outlets.
11. Use according to any of the preceding paragraphs, wherein the at least one enzyme is used in a method for automatic dish washing.
12. Use according to any of the preceding paragraphs, wherein the amylase is wherein the amylase is an alpha-amylase or a glucoamylase.
13. Use according to paragraph 12, wherein the amylase has at least 80% sequence identity to SEQ ID NO: 1 or the amylase has at least 80% sequence identity to SEQ ID NO: 2.
14. Use according to any of the preceding paragraphs, wherein the protease is a serine protease or a metalloprotease, preferably an alkaline microbial protease or a trypsin-like protease.
15. Use according to paragraph 14, wherein the protease has at least 80% sequence identity to SEQ ID NO: 3 the protease has at least 80% sequence identity to SEQ ID NO: 4 or the protease has at least 80% sequence identity to SEQ ID NO: 5.

16. A rinse aid composition comprising at least one enzyme, a non-ionic surfactant and an acid.
17. Composition according to paragraph 16, wherein the composition is granular or liquid.
18. Composition according to paragraph 17, wherein the liquid composition has a pH in the range of 1-7.
19. Composition according to any of paragraphs 17-18, wherein the liquid composition has a pH in the range of 2-6, in the range of 2-4 or in the range of 2.5-3.5.
20. Composition according to any of paragraphs 16-19, wherein the at least one enzyme is amylase.
21. Composition according to any of paragraphs 16-19, wherein the at least one enzyme is protease.
22. Composition according to any of the preceding composition paragraphs, wherein one or more enzymes are used in in addition to the at least one enzyme.
23. Composition according to paragraph 22, wherein the one or more enzymes are selected from the group consisting of hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, R-glucanases, arabinosidases, hyaluronidase, chondroitinase, laccase, DNase chlorophyllases, amylases, perhydrolases, peroxidases, xanthanase and mixtures thereof.
24. Composition according to any of the preceding composition paragraphs, wherein the amount of the non-ionic surfactant is below 15%.
25. Composition according to any of the preceding composition paragraphs, wherein the amount of the non-ionic surfactant is in the range of 5-15%, in the range of 8-15%, in the range of 10-15%, in the range of 5-10% or in the range of 5-8%.
26. Composition according to any of the preceding composition paragraphs, wherein the non-ionic surfactant is selected from alcohol alkoxylates and biobased surfactants.
27. Composition according to paragraph 26, wherein the alcohol alkoxylates are selected from the group consisting of epoxy-capped poly(oxyalkylated) alcohols and alcohol ethoxylates with linear radicals formed from alcohols of native origin having 12 to 18 carbon atoms.
28. Composition according to any of the preceding composition paragraphs, wherein the composition comprises a preservative and/or biocide.
29. Composition according to paragraph 28, wherein the preservative and or biocide is selected from metholisothiazolinone or methylchlorisothiazolinone or a combination of metholisothiazolinone and methylchlorisothiazolinone.
30. Composition according to any of the preceding composition paragraphs, wherein the acid is selected from the group consisting of acetic acid, aspartic acid, benzoic acid, boric acid, bromic acid, citric acid, formic acid, gluconic acid, glutamic acid, lactic acid, malic acid, nitric acid, sulfamic acid, sulfuric acid, tartaric acid, and mixtures thereof.
31. Composition according to paragraph 30, wherein the acid is citric acid.
32. Composition according to any of the preceding composition paragraphs, wherein the composition comprise a glass care ingredient selected from the group consisting of zinc acetate, zinc chloride and bismuth.
33. Composition according to any of the preceding composition paragraphs, wherein the composition comprises: 75-80% water, 5-15% non-ionic surfactant, sodium- or potassium cumentesulfonate, citric acid, zinc acetate, metholisothiazolinone and methylchlorisothiazolinone and an amylase.
34. Composition according to any of the preceding composition paragraphs, wherein the composition does not comprise bleaching agents.
35. Composition according to any of the preceding composition paragraphs, wherein the amylase is wherein the amylase is an alpha-amylase or a glucoamylase.
36. Composition according to paragraph 35, wherein the amylase has at least 80% sequence identity to SEQ ID NO: 1 or the amylase has at least 80% sequence identity to SEQ ID NO: 2.
37. Composition according to any of the preceding composition paragraphs, wherein the enzyme is a protease, which protease is a serine protease or a metalloprotease, preferably an alkaline microbial protease or a trypsin-like protease.
38. Composition according to paragraph 37, wherein the protease has at least 80% sequence identity to SEQ ID NO: 3 the protease has at least 80% sequence identity to SEQ ID NO: 4 or the protease has at least 80% sequence identity to SEQ ID NO: 5.
39. A method for removing soil from a surface, wherein the method comprises the steps of:
    (i) Exposing the surface to a wash liquor, and
    (ii) Rinsing the surface with water comprising at least one enzyme;
    wherein the surface is dishware or a hard surface.
40. Method according to paragraph 39, wherein the wash liquor is removed before step (ii).
41. Method according to any of the preceding method paragraphs, wherein the rinsing in step (ii) comprises more than one rinsing step such as two or three rinsing steps.
42. Method according to paragraph 41, wherein the at least one enzyme is comprised in the water of at least one of the rinsing steps.
43. Method according to any of the preceding paragraphs, wherein in step (ii) the water comprises the composition according to any of paragraphs 16-38.
44. Method according to any of the preceding method paragraphs, wherein the surface is a hard surface in the interior of a dishwashing machine, such as walls, baskets, nozzles, pumps, sump, filters, pipelines, drains, and outlets.
45. Method according to any of the preceding method paragraphs, wherein the method is an automatic dish washing method.
46. Method according to any of the preceding method paragraphs, wherein the method is for removing soil from dishware.
47. Method according to any of the preceding method paragraphs, wherein the enzyme is an alpha-amylase or a glucoamylase.
48. Method according to paragraph 47, wherein the amylase has at least 80% sequence identity to SEQ ID NO: 1 or the amylase has at least 80% sequence identity to SEQ ID NO: 2.
49. Method according to any of the preceding method paragraphs, wherein the enzyme is a protease, which protease is a serine protease or a metalloprotease, preferably an alkaline microbial protease or a trypsin-like protease.

50. Method according to paragraph 49, wherein the protease has at least 80% sequence identity to SEQ ID NO: 3 the protease has at least 80% sequence identity to SEQ ID NO: 4 or the protease has at least 80% sequence identity to SEQ ID NO: 5.

ADW Detergent Compositions

Finish all in 1 Tabs (Reckit Benckiser)

Pentasodium triphosphate, sodium carbonate, sodium carbonate peroxide, aqua, 2-propenoic acid homopolymer (sodium salt, sulfonated), sodium bicarbonate, PEG MW>4100, PEG MW<4100, Cellulose, ceteareth-25, dimethicone, taed, citric acid, sodium sulfate, fatty alcohol alkoxylate, tetrasodium etidronate, glycerol, starch, subtilisin, Mangan Oxalate, titanium dioxide, Methyl-1H-benzotriazole, magnesium stearate, Primary alcohol ethoxylate, limonene, amylase, partum, colorant.

Finish Quantum Tabs (Reckit Benckiser)

Pentasodium triphosphate, polyvinylalcohol, sodium carbonate, sodium carbonate peroxide, 2-propenoic acid homopolymer (sodium salt, sulfonated), fatty alcohol alkoxylate, aqua, PEG MW>4100, tetrasodium etidronate, taed, sodium sulfate, PEG MW<4100, sorbitol, trimethylolpropane, sodium chloride, methyl alcohol, cellulose, dimethicone, Methyl-1H-benzotriazole, subtilisin, titanium dioxide, manganese oxalate (dihydrate), 2-Propenoic acid homopolymer, (sodium salt), C12-13 PARETH-6, citric acid, stereamide, petroleum distillates, Fatty acid; C16-18; Calcium salts, amylase, polyethilenimine, calcium carbonate, Fatty acid; C16-18; Zinc salts, STEARETH-21, Diallyldimethylammonium Chloride, Parfum, colorant.

Model Detergent

Sodium carbonate, sodium citrate, sodium carbonate peroxide, polycarboxylate, taed, non-ionic surfactant, sodium disilicate, peg-75 and vegetable oil.

Rinse Aid Compositions

The present Rinse aid composition can be used together with the enzymes of the invention.

Finish Calgonit Klarspüler Regular or Finish Abrillantador Brillo & Proteccion Regular (Supplied by Reckitt Benkise, Germany and Spain)

Aqua, fatty alcohol alkoxylate, sodium cumenesulfonate, citric acid, zinc acetate, potassium sorbate, methylchloroisothiazolinone, methylisothiazolinone and colorant.

Finish Abrillantador Powder and Pure (Supplied by Reckitt Benkiser, Spain)

Aqua, fatty alcohol alkoxylate, sodium cumenesulfonate, citric acid, potassium sorbate and zinc acetate.

Somat Klarspüler (supplied by Henkel, Germany)

Aqua, alcohol (C-13-15 12.6-EO/2.1-BUO), Alcohol-ethoxylatebutoxylat (C13-15), citric acid, perfume, limonene, methylchloroisothiazolinone and methylisothiazolinone.

W5 Rinse Aid (Supplied by Lidl, Germany)

Aqua, alcoxlated fattyalcohol (012-15), citric acid, sodium cumenesulfonate, potassium cumenesulfonate, perfume, methylchloroisothiazolinone and methylisothiazolinone.

Green Rinse Aid (Supplied by Ecover, Spain)

Aqua, citric acid, *candida bombicola*/glucose/rapeseedoil ferment, denatured alcohol and capryl glucoside.

Xtra Afspændingsmiddel (Rinse Aid Supplied by Coop, Denmark)

Aqua, 5-15% nonionic surfactants (fatty alcohol alkoxylate), citric acid and sodium cumenssulfonate. pH=3.

Neophos Rinse Aid, Regular (Reckit Benckiser)

Aqua, fatty alcohol alkoxylate, sodium cumenesulfonate, citriac acid, zinc acetate, potassium sorbate, methylchloroisothiazolinone, methylisothiazolinone and colorant.

Assays

Assay I

Analysis of Soil Reduction by Weight

The weight of the dishware is measured. A soil composition is prepared and applied at the dishware. The weight of the dishware with soil applied is then measured. The dishware is then washed in a mainwash and rinsed afterwards with water comprising rinse aid, or with water comprising enzymes and rinse aid. The weight of the dishware after washing and rinsing is then measured.

The % soil removed during washing/rinsing is then calculated by comparing the weight of the washed dishware with the weight of the dishware with soil applied.

Assay II

Analysis of Soil Reduction by Visual Scoring

The performance of enzymes can be evaluated by visual scoring. The plates are stained with a iodine and a scale from 0 to 10 is made. 0 is the unwashed dish and 10 is the totally clean plate. Trained test persons score the plates according to this scale and the average of the three scores is the final score.

Wash Assay I—Full Scale Wash

The enzyme preparation was tested using a full scale wash in a Miele GSL2 SCU automatic dishwashing machine. Washing program used was R45/87K155, using artifical water with water hardness 21° dH (Ca2+:Mg2+:HCO3−=4:1:7.5) and with a total washing time of about 90 minutes. The washing programme comprises a washing cycle followed by two rinsing cycles. FIG. 1 shows the the temperature in the automatic dish wash machine versus the washing time. The temperature profile was measured for the R45/87K155 programme during one of the washes performed during the experiment. From the FIGURE it is seen that in the beginning of the wash program, the temperature decreases due to cold water inlet, hereafter the heating begins and continues until the temperature is 44-46 C. The main wash at 44-46° C. continues for about 8-10 minutes after that the water is drained and the temperature decreases. Then clean artificial water is supplied and a small temperature increase is seen up to 34-35° C. This corresponds to the first rinse cycle which lasts for 7 min. After the first rinse cycle the rinse water is drained and clean water artificial is supplied. The water is heated to about 55-56° C. The process of heating up the water lasts for 14-15 min. The rinse water is then drained which ends the second rinse cycle. The temperature in the drying phase slowly decreases. The wash cycle is finished after a total of 90 minutes.

The amount of water in the main wash was 5.4 liter, and the total amount of water in the rinse phase is around 10 liter. The washing was conducted with the commercially available ADW tabs (Finish all in 1, Quantum all in 1) or model detergent was used. Commercial rinse aid without enzymes was added twice during the cycle: 1.5 ml after 35 min and 1.5 ml after 40 min from the moment the wash is started. When testing the effect of adding enzymes to rinse aid, the enzymes were added together with the rinse aid.

50 grams of ballast soil was added into the machine before start. The soil was prepared as shown in appendix 3 on page 44 of SÖFW-Journal, volume 132, No 8-2006. In addition, homemade soils were prepared according to Soil Preparation procedure (below) and 5 dishes of each soil type were included per wash.

Soil Preparation

The home made Egg yolk and mix starch soils were prepared according to the methods described on pages 35-40 of SOFW-Journal, volume 132, No 8-2006 with the following modifications:

Egg yolk soil (page 39): 1.5 g are applied to the stainless steel sheets instead of 1.0 g Mix Starch (pages 38-39): a 5% mix starch solution is prepared and 18 g of it are applied to each plate.

The home made Pasta soil was prepared according to the methods described on pages 45-46 of SOFW-Journal, volume 142, No 6-2016.

EXAMPLES

Example 1

Wash assay I was used to test the effect of using an amylase in ADW rinse aid in combination with a commercial dishwash tab containing amylase and protease.

As detergent Finish all in 1 (from Germany) was used. Neophos rinse aid (from Denmark) was used in the rinsing phase. A total of 3 ml Neophos rinse aid (from Denmark) was used in the rinsing phase. Further, 0.09 gram of amylase SEQ ID NO: 2 was added to the rinse aid during the two rinse phases, as described in Wash Assay I.

The homemade soils used were mix starch and pasta which were prepared according to the Soil preparation procedure.

A first wash was conducted as described in Wash assay I.

The evaluation of the soil removal was done as described in Assay I. The performance on pasta soil is evaluated by visual scoring three trained test persons and according to Assay II.

Results:

| F | Formulations | % Removal on mix starch | Visual evaluation of pasta |
|---|---|---|---|
| 1 | Finish all in 1 + rinse aid with amylase | 98.8 | 7.4 |
| 2 | Finish all in 1 + rinse aid no enzyme | 66.1 | 6.8 |

Example 2

Wash assay I was used to test the effect of using an amylase in ADW rinse aid in combination with a commercial dish wash tab containing amylase and protease.

As detergent Finish Quantum all in 1 (from Germany) was used. A total of 3 ml Neophos rinse aid (from Denmark) was used in the rinsing phase. Further, 0.09 gram of amylase SEQ ID NO: 2 was added during the rinse aid phase, as described in Wash Assay I.

The homemade soils used were mix starch and pasta which were prepared according to the Soil preparation procedure.

A first wash was then completed as described in Wash assay I.

The evaluation of the soil removal was done as described in Assay I. The performance on pasta soil is evaluated by visual scoring three trained test persons and according to Assay II.

Results:

| F | Formulations | % Removal on mix starch | Visual evaluation of pasta |
|---|---|---|---|
| 1 | Finish all in 1 + rinse aid with amylase | 95.8 | 7.5 |
| 2 | Finish all in 1 + rinse aid no enzyme | 61.1 | 4.8 |

Example 3

Wash assay I was used to test the effect of using an amylase and a protease in ADW rinse aid in combination with a model detergent containing no enzymes.

As detergent 20 g of model detergent was used. A total of 3 ml Neophos rinse aid (from Denmark) was used in the rinsing phase. Further, 0.6 gram of amylase SEQ ID NO: 2 and 1.8 g of protease SEQ ID NO: 5 were added during the rinse aid phase, as described in Wash Assay I.

The homemade soils used were mix starch and egg yolk which were prepared according to the Soil preparation procedure.

A wash was conducted as described in Wash assay I.

The evaluation of the soil removal was done as described in Assay I

Results:

| F | Formulations | % Removal on mix starch | % Removal on egg yolk |
|---|---|---|---|
| 1 | Model detergent + rinse aid with amylase & protease | 100 | 33.6 |
| 2 | Model detergent + rinse aid no enzyme | 10.1 | 14.0 |

Example 4

Wash assay I was used to test the effect of using an amylase and a protease in ADW rinse aid in combination with a model detergent containing amylase and protease.

As detergent 20 g of model detergent was used. 0.6 g of protease SEQ ID NO: 4 and 0.2 g of amylase SEQ ID NO: 1) were added to the detergent. A total of 3 ml Neophos rinse aid (from Denmark) was used in the rinsing phase. Further, 0.09 gram of amylase SEQ ID NO: 2 and 0.27 g of protease SEQ ID NO: 5 were added during the rinse aid phase, as described in Wash assay I. The homemade soils used were mix starch and egg yolk and were prepared according to the Soil preparation procedure.

A wash was conducted as described in Wash assay I.

The evaluation of the soil removal was done as described in Assay I

| F | Formulations | % Removal on mix starch | % Removal on egg yolk |
|---|---|---|---|
| 1 | Detergent including amylase and protease + rinse aid with amylase & protease | 94.5 | 64.1 |
| 2 | Detergent including amylase and protease + rinse aid no enzyme | 68.5 | 64.4 |

SEQUENCE LISTING

<160> NUMBER OF SEQ ID NOS: 5

<210> SEQ ID NO 1
<211> LENGTH: 483
<212> TYPE: PRT
<213> ORGANISM: Artificial Sequence
<220> FEATURE:
<223> OTHER INFORMATION: variant

<400> SEQUENCE: 1

```
His His Asn Gly Thr Asn Gly Thr Leu Met Gln Tyr Phe Glu Trp Tyr
1               5                   10                  15

Leu Pro Asn Asp Gly Asn His Trp Asn Arg Leu Arg Ser Asp Ala Ser
            20                  25                  30

Asn Leu Lys Asp Lys Gly Ile Ser Ala Val Trp Ile Pro Pro Ala Trp
        35                  40                  45

Lys Gly Ala Ser Gln Asn Asp Val Gly Tyr Gly Ala Tyr Asp Leu Tyr
    50                  55                  60

Asp Leu Gly Glu Phe Asn Gln Lys Gly Thr Ile Arg Thr Lys Tyr Gly
65                  70                  75                  80

Thr Arg Asn Gln Leu Gln Ala Ala Val Asn Ala Leu Lys Ser Asn Gly
                85                  90                  95

Ile Gln Val Tyr Gly Asp Val Val Met Asn His Lys Gly Gly Ala Asp
            100                 105                 110

Ala Thr Glu Met Val Lys Ala Val Glu Val Asn Pro Asn Asn Arg Asn
        115                 120                 125

Gln Glu Val Ser Gly Glu Tyr Thr Ile Glu Ala Trp Thr Lys Phe Asp
    130                 135                 140

Phe Pro Gly Arg Ala Asn Thr His Ser Asn Phe Lys Trp Arg Trp Tyr
145                 150                 155                 160

His Phe Asp Gly Val Asp Trp Asp Gln Ser Arg Lys Leu Asn Asn Arg
                165                 170                 175

Ile Tyr Lys Phe Arg Thr Lys Ala Trp Asp Trp Glu Val Asp Thr Glu
            180                 185                 190

Phe Gly Asn Tyr Asp Tyr Leu Leu Tyr Ala Asp Ile Asp Met Asp His
        195                 200                 205

Pro Glu Val Val Asn Glu Leu Arg Asn Trp Gly Val Trp Tyr Thr Asn
    210                 215                 220

Thr Leu Gly Leu Asp Gly Phe Arg Ile Asp Ala Val Lys His Ile Lys
225                 230                 235                 240

Tyr Ser Phe Thr Arg Asp Trp Ile Asn His Val Arg Ser Ala Ile Gly
                245                 250                 255

Lys Asn Met Phe Ala Val Ala Glu Phe Trp Lys Asn Asp Leu Gly Ala
            260                 265                 270

Ile Glu Asn Tyr Leu Asn Lys Thr Asn Trp Asn His Ser Val Phe Asp
        275                 280                 285

Val Pro Leu His Phe Asn Leu Tyr Tyr Ala Ser Lys Ser Gly Gly Asn
    290                 295                 300

Tyr Asp Met Arg Gln Ile Phe Asn Gly Thr Val Val Gln Lys His Pro
305                 310                 315                 320

Thr His Ala Val Thr Phe Val Asp Asn His Asp Ser Gln Pro Glu Glu
                325                 330                 335

Ser Leu Glu Ser Phe Val Arg Glu Trp Phe Lys Pro Leu Ala Tyr Ala
            340                 345                 350

Leu Thr Leu Thr Arg Glu Gln Gly Tyr Pro Ser Val Phe Tyr Gly Asp
```

```
        355                 360                 365

Tyr Tyr Gly Ile Pro Thr His Gly Val Pro Ala Met Lys Ser Lys Ile
    370                 375                 380

Asp Pro Ile Leu Glu Ala Arg Gln Lys Tyr Ala Tyr Gly Arg Gln Asn
385                 390                 395                 400

Asp Tyr Leu Asp His His Asn Ile Ile Gly Trp Thr Arg Glu Gly Asn
                405                 410                 415

Thr Ala His Pro Asn Ser Gly Leu Ala Thr Ile Met Ser Asp Gly Ala
            420                 425                 430

Gly Gly Asn Lys Trp Met Phe Val Gly Arg Asn Lys Ala Gly Gln Val
        435                 440                 445

Trp Thr Asp Ile Thr Gly Asn Lys Ala Gly Thr Val Thr Ile Asn Ala
    450                 455                 460

Asp Gly Trp Gly Asn Phe Ser Val Asn Gly Gly Ser Val Ser Ile Trp
465                 470                 475                 480

Val Asn Lys


<210> SEQ ID NO 2
<211> LENGTH: 482
<212> TYPE: PRT
<213> ORGANISM: Artificial Sequence
<220> FEATURE:
<223> OTHER INFORMATION: variant

<400> SEQUENCE: 2

His Asp Gly Thr Asn Gly Thr Ile Met Gln Tyr Phe Glu Trp Asn Val
1               5                   10                  15

Pro Asn Asp Gly Gln His Trp Asn Arg Leu His Asn Asn Ala Gln Asn
            20                  25                  30

Leu Lys Asn Ala Gly Ile Thr Ala Ile Trp Ile Pro Pro Ala Trp Lys
        35                  40                  45

Gly Thr Ser Gln Ser Asp Thr Gly Tyr Gly Ala Tyr Asp Leu Tyr Asp
    50                  55                  60

Leu Gly Glu Phe Asn Gln Arg Gly Thr Val Arg Thr Lys Tyr Gly Thr
65                  70                  75                  80

Lys Ala Glu Leu Glu Arg Ala Ile Arg Ser Leu Lys Ala Asn Gly Ile
                85                  90                  95

Gln Val Tyr Gly Asp Val Val Met Asn His Lys Ala Gly Ala Asp Gln
            100                 105                 110

Thr Glu Gln Val Gln Ala Val Glu Val Asn Pro Gln Asn Arg Asn Gln
        115                 120                 125

Glu Val Ser Gly Thr Tyr Gln Ile Glu Ala Trp Thr Gly Phe Asn Phe
    130                 135                 140

Pro Gly Arg Gly Asn Gln His Ser Ser Phe Lys Trp Arg Trp Tyr His
145                 150                 155                 160

Phe Asp Gly Thr Asp Phe Asp Gln Ser Arg Gly Leu Ser Asn Arg Ile
                165                 170                 175

Tyr Lys Phe Arg Thr Lys Ala Trp Asp Trp Glu Val Asp Thr Glu Phe
            180                 185                 190

Gly Asn Tyr Asp Tyr Leu Met Tyr Ala Asp Leu Asp Met Asp His Pro
        195                 200                 205

Glu Val Ile Asn Glu Leu Asn Arg Trp Gly Val Trp Tyr Ala Asn Thr
    210                 215                 220

Leu Asn Leu Asp Gly Phe Arg Leu Asp Ala Val Lys His Ile Lys Phe
225                 230                 235                 240
```

```
Ser Phe Met Arg Asp Trp Leu Gly His Val Arg Gly Gln Thr Gly Lys
                245                 250                 255

Asn Leu Phe Ala Val Ala Glu Tyr Trp Lys Asn Asp Leu Gly Ala Leu
            260                 265                 270

Glu Asn Tyr Leu Ser Lys Thr Asn Trp Thr Met Ser Ala Phe Asp Val
        275                 280                 285

Pro Leu His Tyr Asn Leu Tyr Gln Ala Ser Asn Ser Ser Gly Asn Tyr
    290                 295                 300

Asp Met Arg Asn Leu Leu Asn Gly Thr Leu Val Gln Arg His Pro Ser
305                 310                 315                 320

His Ala Val Thr Phe Val Asp Asn His Asp Thr Gln Pro Gly Glu Ala
                325                 330                 335

Leu Glu Ser Phe Val Gln Gly Trp Phe Lys Pro Leu Ala Tyr Ala Thr
            340                 345                 350

Ile Leu Thr Arg Glu Gln Gly Tyr Pro Gln Val Phe Tyr Gly Asp Tyr
        355                 360                 365

Tyr Gly Ile Pro Ser Asp Gly Val Pro Ser Tyr Arg Gln Gln Ile Asp
    370                 375                 380

Pro Leu Leu Ala Ala Arg Gln Gln Tyr Ala Tyr Gly Thr Gln His Asp
385                 390                 395                 400

Tyr Leu Asp Asn Gln Asp Val Ile Gly Trp Thr Arg Glu Gly Asp Ser
                405                 410                 415

Ala His Ala Gly Ser Gly Leu Ala Thr Val Met Ser Asp Gly Pro Gly
            420                 425                 430

Gly Ser Lys Thr Met Tyr Val Gly Thr Ala His Ala Gly Gln Val Phe
        435                 440                 445

Lys Asp Ile Thr Gly Asn Arg Thr Asp Thr Val Thr Ile Asn Ser Ala
    450                 455                 460

Gly Asn Gly Thr Phe Arg Cys Asn Lys Gly Ser Val Ser Ile Trp Val
465                 470                 475                 480

Lys Gln


<210> SEQ ID NO 3
<211> LENGTH: 269
<212> TYPE: PRT
<213> ORGANISM: Artificial Sequence
<220> FEATURE:
<223> OTHER INFORMATION: variant

<400> SEQUENCE: 3

Ala Gln Ser Val Pro Trp Gly Ile Ser Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asn Asn Ser Ile Gly Val Leu
65                  70                  75                  80

Gly Val Ala Pro Ser Ala Glu Leu Tyr Ala Val Lys Val Leu Gly Ala
                85                  90                  95

Ser Gly Ser Gly Ser Val Ser Ser Ile Ala Gln Gly Leu Glu Trp Ala
            100                 105                 110
```

```
Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Gly Ser Ile Ser
145                 150                 155                 160

Ala Pro Ala Ser Tyr Ala Asn Ala Met Ala Val Gly Ala Thr Asp Gln
                165                 170                 175

Asn Asn Asn Arg Ala Ser Phe Ser Gln Tyr Gly Pro Gly Leu Asp Ile
            180                 185                 190

Val Ala Pro Gly Val Asn Val Gln Ser Thr Tyr Pro Gly Ser Thr Tyr
        195                 200                 205

Ala Ser Leu Asn Gly Thr Ser Met Ala Thr Pro His Val Ala Gly Ala
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Ser Thr Asn Leu
                245                 250                 255

Tyr Gly Ser Gly Leu Val Asn Ala Glu Ala Ala Thr Arg
            260                 265


<210> SEQ ID NO 4
<211> LENGTH: 269
<212> TYPE: PRT
<213> ORGANISM: Artificial Sequence
<220> FEATURE:
<223> OTHER INFORMATION: variant

<400> SEQUENCE: 4

Ala Gln Ser Val Pro Trp Gly Ile Arg Arg Val Gln Ala Pro Thr Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
        35                  40                  45

Phe Val Pro Gly Glu Pro Ser Thr Gln Asp Gly Asn Gly His Gly Thr
    50                  55                  60

His Ala Ala Gly Thr Ile Ala Ala Leu Asn Asn Ser Ile Gly Val Leu
65                  70                  75                  80

Gly Val Ala Pro Ser Ala Glu Leu Tyr Ala Val Lys Val Leu Gly Ala
                85                  90                  95

Ser Gly Ser Gly Ser Val Ser Ser Ile Ala Gln Gly Leu Glu Trp Ala
            100                 105                 110

Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Gly Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Val Gln Ser Thr Tyr Pro Gly Ser Thr Tyr
        195                 200                 205
```

```
Ala Ser Leu Asp Gly Thr Ser Met Ala Thr Pro His Val Ala Gly Ala
    210                 215                 220

Ala Ala Leu Val Lys Gln Lys Asn Pro Ser Trp Ser Asn Val Arg Ile
225                 230                 235                 240

Arg Asn His Leu Lys Asn Thr Ala Thr Ser Leu Gly Ser Thr Asn Leu
                245                 250                 255

Tyr Gly Ser Gly Leu Val Asn Ala Glu Ala Ala Thr Arg
            260                 265


<210> SEQ ID NO 5
<211> LENGTH: 269
<212> TYPE: PRT
<213> ORGANISM: Artificial Sequence
<220> FEATURE:
<223> OTHER INFORMATION: variant

<400> SEQUENCE: 5

Ala Gln Ser Val Pro Trp Gly Ile Glu Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Arg Ile Arg Gly Gly Ala Ser
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asp Asn Ser Ile Gly Val Leu
65                  70                  75                  80

Gly Val Ala Pro Ser Ala Glu Leu Tyr Ala Val Lys Val Leu Gly Ala
                85                  90                  95

Ser Gly Ser Gly Ser Val Ser Ser Ile Ala Gln Gly Leu Glu Trp Ala
            100                 105                 110

Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Gly Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Ile Leu Ser Thr Trp Pro Gly Ser Thr Tyr
        195                 200                 205

Ala Ser Leu Asn Gly Thr Ser Met Ala Thr Pro His Val Ala Gly Ala
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Asp Thr Trp Glu
                245                 250                 255

Tyr Gly Ser Gly Leu Val Asn Ala Glu Ala Ala Thr Arg
            260                 265
```

The invention claimed is:

1. A rinse aid composition comprising at least two enzymes, a non-ionic surfactant and an acid, wherein the at least two enzymes are the alpha-amylase of SEQ ID NO: 1 or SEQ ID NO: 2, or an alpha-amylase having at least 80% sequence identity to SEQ ID NO: 1 or SEQ ID NO: 2, and the protease of SEQ ID NO: 3, SEQ ID NO: 4, or SEQ ID NO: 5, or a protease having at least 80% sequence identity to SEQ ID NO: 3, SEQ ID NO: 4, or SEQ ID NO: 5.

2. The composition according to claim 1, wherein the composition is granular or liquid and wherein the liquid composition has a pH in the range of 1-7.

3. The composition according to claim 1, further comprising one or more additional enzymes, wherein the one or more enzymes are selected from the group consisting of hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, DNase chlorophyllases, amylases, perhydrolases, peroxidases, xanthanase and mixtures thereof.

4. The composition according to claim 1, wherein the amount of the non-ionic surfactant is below 15%.

5. A method for removing soil from a surface, wherein the method comprises the steps of:

(i) Exposing the surface to a wash liquor, and (ii) Rinsing the surface with water comprising at least two enzymes;

wherein the surface is dishware or a hard surface, wherein the at least two enzymes are the alpha-amylase of SEQ ID NO: 1 or SEQ ID NO: 2, or an alpha-amylase having at least 80% sequence identity to SEQ ID NO: 1 or SEQ ID NO: 2, and the protease of SEQ ID NO: 3, SEQ ID NO: 4, or SEQ ID NO: 5, or a protease having at least 80% sequence identity toe SEQ ID NO: 3, SEQ ID NO: 4, or SEQ ID NO: 5.

6. The method according to claim 5, wherein the rinsing in step (ii) comprises more than one rinsing step and wherein the at least two enzymes are comprised in the water of at least one of the rinsing steps.

7. The method according to claim 6, wherein in step (ii) the water comprises the rinse aid composition.

8. The method according to claim 5, wherein the surface is a hard surface in the interior of a dishwashing machine.

9. The method according to claim 5, wherein the method is an automatic dish washing method.

10. The method according to claim 5, wherein the rinsing in step (ii) comprises two rinsing steps.

11. The method according to claim 5, wherein the rinsing in step (ii) comprises three rinsing steps.

12. The method according to claim 5, wherein the surface is selected from the group consisting of a wall, a basket, a nozzle, a pump, a sump, a filter, a pipeline, drain, and outlet.

13. The composition according to claim 1, wherein the alpha-amylase has 85% sequence identity to SEQ ID NO: 1 or SEQ ID NO: 2.

14. The composition according to claim 1, wherein the alpha-amylase has 90% sequence identity to SEQ ID NO: 1 or SEQ ID NO: 2.

15. The composition according to claim 1, wherein the protease has 85% sequence identity to SEQ ID NO: 3, SEQ ID NO: 4, or SEQ ID NO: 5.

16. The composition according to claim 1, wherein the protease has 90% sequence identity to SEQ ID NO: 3, SEQ ID NO: 4, or SEQ ID NO: 5.

17. The method according to claim 5, wherein the alpha-amylase has 85% sequence identity to SEQ ID NO: 1 or SEQ ID NO: 2.

18. The method according to claim 5, wherein the alpha-amylase has 90% sequence identity to SEQ ID NO: 1 or SEQ ID NO: 2.

19. The method according to claim 5, wherein the protease has 85% sequence identity to SEQ ID NO: 3, SEQ ID NO: 4, or SEQ ID NO: 5.

20. The method according to claim 5, wherein the protease has 90% sequence identity to SEQ ID NO: 3, SEQ ID NO: 4, or SEQ ID NO: 5.

* * * * *